US012291935B2

(12) United States Patent
Cunningham

(10) Patent No.: US 12,291,935 B2
(45) Date of Patent: May 6, 2025

(54) APPARATUS FOR FITTING TO A WELLBORE, DOWNHOLE TOOL, LUBRICATOR FOR FITTING TO A WELLHEAD AND METHOD OF TRANSFERRING POWER

(71) Applicant: Expro North Sea Limited, Dyce (GB)

(72) Inventor: Gordon Cunningham, Stirling (GB)

(73) Assignee: Expro North Sea Limited, Stirling (GB)

( * ) Notice: Subject to any disclaimer, the term of this patent is extended or adjusted under 35 U.S.C. 154(b) by 70 days.

(21) Appl. No.: 18/080,455

(22) Filed: Dec. 13, 2022

(65) Prior Publication Data

US 2023/0184049 A1 Jun. 15, 2023

(30) Foreign Application Priority Data

Dec. 13, 2021 (GB) ..... 2118028

(51) Int. Cl.
*E21B 33/068* (2006.01)
*E21B 44/02* (2006.01)

(52) U.S. Cl.
CPC ..... *E21B 33/068* (2013.01); *E21B 44/02* (2013.01)

(58) Field of Classification Search
CPC ..... E21B 33/068
See application file for complete search history.

(56) References Cited

U.S. PATENT DOCUMENTS

2010/0106422 A1* 4/2010 Byrne ..... E21B 47/008 702/6
2013/0240197 A1* 9/2013 Hallundæk et al. .... E21B 23/00 166/66.4
2013/0319661 A1* 12/2013 Xiao ..... E21B 43/121 166/250.03
2017/0204702 A1* 7/2017 Hansen ..... E21B 33/068
2020/0157909 A1* 5/2020 Fernandes ..... E21B 34/02
2020/0332618 A1 10/2020 Eitschberger

FOREIGN PATENT DOCUMENTS

EP 2458137 B1 11/2018
WO WO-2009154501 A1 * 12/2009 ..... E21B 47/122
WO 2021234171 A1 11/2021

* cited by examiner

*Primary Examiner* — Giovanna Wright
(74) *Attorney, Agent, or Firm* — Getz Balich LLC

(57) ABSTRACT

An apparatus for fitting to a wellbore is provided. The apparatus includes a battery-powered downhole tool for deployment within the wellbore. The downhole tool includes a battery for providing electrical power to one or more components of the downhole tool. The apparatus further includes a lubricator for fitting to a wellhead of the wellbore via a valve system providing communication between the lubricator and the wellbore, and for housing the downhole tool when in a stowed position. The lubricator includes a transmitter for receiving electrical power from a remote power source, and for transferring received electrical power to a receiver. The downhole tool includes a receiver for providing electrical power to the battery, and for receiving electrical power from the transmitter. A method of transferring power from a transmitter of a lubricator to a receiver of a downhole tool is also provided.

17 Claims, 8 Drawing Sheets

APPARATUS FOR FITTING TO A WELLBORE, DOWNHOLE TOOL, LUBRICATOR FOR FITTING TO A WELLHEAD AND METHOD OF TRANSFERRING POWER

This application claims priority to Great Britain Patent Appln. No. 2118028.6 filed Dec. 13, 2021, which is hereby incorporated herein by reference in its entirety.

BACKGROUND OF THE INVENTION

1. Technical Field

The subject application generally relates to powered downhole tools, and in particular to an apparatus for fitting to a wellbore, a lubricator for fitting to a wellhead of a wellbore, and a method of transferring power.

2. Background Information

In the oil and gas industry, well boreholes ("wellbores") are drilled in order to access subsurface hydrocarbon-bearing formations. In order to control production from a given wellbore, a valve arrangement known as a Christmas (X-mas) tree is typically disposed on the wellhead, the valve arrangement comprising a number of flow control valves and safety valves configured amongst other things to control production, permit well isolation, and control access of downhole tools and equipment into/from the wellbore.

During the operational life of a given well, it may be necessary to access the wellbore in order to perform remedial operations, known generally in the industry as intervention or workover operations.

However, while necessary, intervention operations pose a number of challenges for operators. For example, wellbores may be located in remote or relatively inaccessible locations, making them difficult and time consuming to access, particularly for intervention operations which require significant man-power to operate and/or which require equipment which by virtue of size or weight may be restricted or prevented by local infrastructure laws. Wellbores may also be located in areas of particular scientific or environmental sensitivity. The given location may also pose challenges in terms of how to protect the environment, intervention equipment and personnel.

An operator may wish to carry out intervention operations a number of times in order to mitigate deferred production or otherwise maintain production at optimal levels. One such intervention operation involves the removal of paraffin wax, asphaltenes and/or other solids, residues and the like which can accumulate in the wellbore over time and which reduce production or otherwise reduce the optimal operation of the well.

In some instances, a given field may include a significant number of wells, some fields having hundreds of wells, making intervention operations difficult and in some cases prohibitively expensive to carry out regularly given the above factors and demands on personnel and equipment.

A number of intervention operations may be carried out using powered tools, such as battery-powered tools, deployed on slickline. Typically, a tool is introduced to the well on a slickline through a stuffing box, which is designed to seal around the slickline to prevent well fluids and gases escaping. In known arrangements, the stuffing box includes a sheave or pulley assembly with a number of pulley wheels for guiding the slickline into the well. The slickline may be used to deploy the tool into the wellbore and/or to retrieve the tool from the wellbore.

This background serves only to set a scene to allow a person skilled in the art to better appreciate the following description. Therefore, none of the above discussion should necessarily be taken as an acknowledgement that that discussion is part of the state of the art or is common general knowledge. One or more aspects/embodiments of the disclosure may or may not address one or more of the background issues.

SUMMARY

According to an aspect of the disclosure an apparatus for fitting to a wellbore is provided.

The apparatus may reduce production down-time and improve overall operation efficiency. Specifically, the apparatus may permit intervention operations to be carried out autonomously.

The apparatus may comprise: a battery-powered downhole tool for deployment within the wellbore; a lubricator for housing the downhole tool when in a stowed position, the lubricator comprising a transmitter for receiving electrical power from a remote power source, and for transferring received electrical power to a receiver; and the downhole tool comprising a receiver for providing electrical power to the battery of the downhole tool, and for receiving electrical power from the transmitter.

The apparatus may permit wellbore integrity to be managed and production maintained safely and efficiently while at the same time permitting repetitive intervention operations, such as paraffin wax melting operations for example, to be carried out autonomously. The apparatus may reduce the environmental impact on the surrounding environment, for example reducing the requirement for large and heavy vehicles; reduce carbon emissions, and noise. Vehicle fleet management and personnel costs may also be reduced. The apparatus may be configured to operate automatically and independently of any manual intervention, and configured to deploy specialist tools or tooling, for example to remediate solids build up, gather bottom-hole data or reconfigure a wellbore completion, saving costs, reducing personnel health and safety exposure and optimizing or improving production up-time.

In operation, the downhole tool may be deployed within the wellbore to complete an intervention operation. The downhole tool may be propelled via tractor or may be gravity-deployed on a slickline, digital slickline or braided line. Conducting the operation may at least partially deplete electrical power from a battery of the downhole tool.

Upon completion of the operation, the downhole tool may return to the stowed position in the lubricator. In the stowed position, the receiver may extract electrical power from the transmitter and provide electrical power to a battery of the downhole tool. Thus, the downhole tool need not be removed from the lubricator for the depleted or spent battery to be replaced or recharged. This may safely permit repeated operations to be completed more quickly which may increase operational efficiency and save cost. Further, removing the downhole from the lubricator may release potentially harmful fluids from the lubricator into the environment. As such providing power to a battery of the downhole tool in-situ, i.e. while the downhole tool is in the lubricator, may reduce the potential for negative environmental impact.

The stowed position may be defined as a position of the downhole tool within the lubricator in electrical power may be transferred from the transmitter of the lubricator to the receiver of the downhole tool. The downhole tool may be moveable from the stowed position to a deployed position for performing one or more downhole or intervention operations. In the downhole position less, little or no electrical power may be transferred from the transmitter to the receiver as compared to the stowed position. In other words, in the stowed position, electrical power transfer between the transmitter and receiver is optimized. In this context optimal electrical power transfer may be defined as maximizing electrical power transfer between the transmitter and receiver.

While an e-line may provide power to the downhole tool and be used to deploy the downhole into the wellbore, the additional sealing requirements to ensure fluid is not released from the lubricator may be increase complexity and costs of the lubricator.

Further the additional sealing requirements risk the introduction of particular such as sand or other matter into the lubricator which may negatively impact downhole operations.

The transmitter may be defined as a component able to transfer, convey or communicate electrical power to a receiver. The receiver may be defined as a component able to extract, or receive electrical power from a transmitter. The transmitter and receiver form an electrical connection between them such that electrical power is transferred from the transmitter to the receiver.

The electrical connection may be a physical connection. The physical connection my comprise plug and socket elements for a wet-mate connector design. The transmitter may comprise an electrical connector with the receiver comprising a mating electrical connector to allow electrical power to be transferred between the connectors.

The electrical connection may be a wireless connection, for example an electromagnetic, electrical field inductive or magnetic field induction system. The electrical connection may be achieved with a wireless power transmission system. In such a system the transmitter, driven by electric power from a power source, generates a time-varying electromagnetic field, which transmits power across space to the receiver, which extracts power from the field and supplies it to the battery of the downhole tool. The field may be an electric or magnetic field, or a combination of both. Electric power may be transferred/extracted via resonant/non-resonant magnetic and/or electric field coupling.

The downhole tool may comprise a battery for providing electrical power to one or more components of the downhole tool. The battery may provide power to an electric motor configured to propel the downhole tool. The battery may provide power to one or more sensors equipped on the downhole tool. Additional components powered by the battery may include heaters; communication modules for communicating data, i.e. receiving and/or receiving senor or control data; electric motors; valves; pumps; and processors.

The battery may include a series of batteries connected together to provide electrical power to components of the downhole tool.

The lubricator may be for fitting to a wellhead of the wellbore via a valve system providing communication between the lubricator and the wellbore. The lubricator may comprise connected tubing sections.

The transmitter may be co-planar with the receiver when the downhole tool is in the stowed position. The transmitter and receiver may be in the same plane in the x-axis (horizontal axis) or in the y-axis (vertical axis). The transmitter and receiver may be co-axial such that the transmitter and receiver have the same central axis when the downhole tool is in the stowed position. Co-planar or co-axial transmitter and receiver may improve or increase electrical power transfer efficiency between the transmitter and receiver.

The transmitter may be integral with the lubricator. The transmitter may be built into a wall of the lubricator. The transmitter may be built into a sidewall, or top or upper wall of the lubricator. This may reduce the distance between the transmitter and the receiver of the downhole tool which may improve or increase electrical power transfer efficiency between the transmitter and receiver.

The transmitter may be positioned or formed in the lubricator such that the transmitter is aligned with the receiver when the downhole tool is in the stowed position. Aligning the transmitter and receiver may improve or increase electrical power transfer efficiency between the transmitter and receiver.

The stowed position may be predefined such that the downhole tool is in the same predefined position when it is housed in the lubricator in the stowed position. The predefined position may be selected to optimize electrical power transfer efficiency between the transmitter and receiver.

The apparatus may further comprise an alignment guide for aligning the transmitter of the lubricator with the receiver of the downhole tool. Aligning the transmitter and receiver may comprise positioning one or more of the receiver and transmitter such that electrical power transfer efficiency between the transmitter and receiver is optimized or maximized. Alternatively, or additionally, the downhole tool or the lubricator may comprise the alignment guide.

The alignment guide may comprise magnetic position indicators or magnets. At least one indicator may be positioned in the downhole tool, and at least one indicator may be positioned in the lubricator. When the magnet in the downhole tool is aligned with the magnet in the lubricator, an alarm may sounds and/or the winch controlling operation of the wireline may stop such that the downhole tool in the optimal position within the lubricator for electrical power transfer.

The alignment guide may be configured to align the transmitter with the receiver when the downhole tool is in the stowed position. This alignment may improve, increase or maximize electrical power transfer efficiency between the transmitter and receiver.

The alignment guide may comprise mating elements on the downhole tool and the inner surface of the lubricator such that the downhole tool the pre-defined position when it is in the stowed position.

The alignment guide may comprise one or more magnets in the downhole tool and the lubricator. Magnets may be positioned in the sidewall of the lubricator. When the downhole tool is housed in the stowed position in the lubricator, the magnets of the downhole tool may be aligned with the magnets in the lubricator.

The alignment guide may comprise one or more of springs, bumpers, indents, and geometric structures to position the downhole tool in a selected position in the lubricator, e.g. the stowed position.

The apparatus may further comprise a controller for controlling at least one of electrical power transfer from the transmitter to the receiver, and deployment of the downhole tool within the wellbore. The controller may optimize electrical power transfer between the transmitter and receiver.

Controlling deployment of the downhole tool within the wellbore via the controller may ensure the downhole tool is only deployed when a battery of the downhole tool has sufficient electrical power. Sufficient power may be sufficient electrical power to complete one or more downhole operations, e.g. removal of paraffin wax, asphaltenes and/or other solids or residues from the wellbore.

The controller may be configured to control electrical power transfer or deployment of the downhole tool based on a parameter satisfying a threshold. Satisfying the threshold may comprise a parameter meeting or exceeding a threshold.

The parameter may comprise a power level of the battery, a temperature of the battery, and a power transfer efficiency between the transmitter and receiver. For example, when the power level of the battery exceeds 80% the controller may deploy the downhole tool in the wellbore. When the power level of the battery does not exceed 80% the controller may not permit deployment of the downhole tool, but instead continue charging of the battery via electrical power transfer from the transmitter to the receiver until the battery exceeds 80%.

The apparatus may further comprise a sensor for sensing a parameter comprising a status of the battery, a power level of the battery, a temperature of the battery, and a power transfer efficiency between the transmitter and receiver. The sensor may comprise an electrical power sensor, a temperature sensor, a resistance sensor, and a sensor configured to detect other electrical parameters such as impedance, capacitance, inductance, etc. The apparatus may comprise multiple sensors.

The receiver may be configured to extract electrical power from the transmitter when the downhole tool is in the stowed position. The transmitter may be configured to transfer electrical power to the receiver when the downhole tool is in the stowed position.

The receiver may be configured to extract electrical power from the transmitter via wireless power transfer. The transmitter may be configured to transfer electrical power to the receiver via wireless power transfer.

Extracting/transferring electrical power via wireless power transfer may remove the need for physical electrical connection between the transmitter and receiver. As such wireless power transfer may remove the need for sealing arrangements to seal such physical electrical connections. This may reduce the risk of negative environmental impacts as there is a reduced risk of release of fluids from the lubricator to the environmental due to fewer potential leak paths in the apparatus.

The transmitter may be configured to transfer electrical power to the receiver via electric field and/or magnetic field coupling. The receiver may be configured to extract electrical power from the transmitter via electric field and/or magnetic field coupling. The transmitter and/or receiver may be resonant during wireless power transfer.

The receiver may be configured to extract electrical power from the transmitter via wired electrical connection. The transmitter may be configured to transfer electrical power to the receiver via wired electrical connection.

The transmitter may comprise an electrical connector. The receiver may comprise a corresponding electrical connector. The electrical connectors may be configured to establish an electrical connection to transfer electrical power from the transmitter to the receiver. The electrical connection may be a physical connection between the connectors. The physical connection may comprise plug and socket elements for a wet-mate connector design.

The electrical connectors may be configured to establish the electrical connection to transfer electrical power from the transmitter to the receiver when the downhole tool is in the stowed position. In other words positioning the downhole tool in the stowed position in the lubricator may establish the electrical connection between the connectors. The connectors may be connected such that electrical power may be transferred from the transmitter to the receiver. The connectors may comprise wet-mate connectors.

The connectors may be configured to additionally establish a data connection to transfer one or more data signals between the transmitter and receiver. Exemplary data signals or communications include one or more instructions for setting deployment parameters for a deployment of the downhole tool. The deployment parameters may comprise one or more of a depth to which the downhole tool should be driven or descend into the wellbore, a speed of drive of the downhole tool, a sensor reading to take, an operation to undertake, and a timing of any of the above or another deployment parameter.

The downhole tool may be configured for deployment within the wellbore via a slickline.

The slickline may be connected to the downhole tool via a rope socket.

The apparatus may comprise a rope socket connected to the downhole tool. The rope socket may be for connection to a slickline for use in deployed the downhole tool in the wellbore. The downhole tool may be connected to the rope socket via a screwed connection.

The rope socket may be positioned between the transmitter and receiver when the downhole tool is in the stowed position.

The rope socket may be coated in an insulator so as to not negatively affect power transfer efficiency between the transmitter and receiver. A passive electrode may be positioned around the rope socket such that the rope socket does not negatively affect power transfer efficiency between the transmitter and receiver.

The downhole tool may be self-propelled and configured to propel itself along at least part of a length of the wellbore. The self-propelled downhole tool may be configured to operate autonomously.

The battery may provide power for propelling the self-propelled downhole tool.

Power may be provided to the transmitter from a remote power source. The remote power source may be electrically connected to the transmitter.

The apparatus may further comprise a remote power source electrically connected to the transmitter. The remote power source may comprise a diesel generator, grid supply, battery grid, or renewable power source such as an offshore or onshore wind turbine, one or more solar panels, biomass plant, tidal power plant.

One or more electrical components may be electrically connected between the remote power source and the transmitter. The electrical components may comprise rectifiers, electrical power converters, transformers, capacitors, resistors, and capacitors. The rectifier may be for rectifying an alternating current (AC) power signal output by the remote power source to a direct current (DC) power signal for transmission to the transmitter. The power converter may be for converting a voltage or amperage of a power signal output by the remote power source to a particular voltage or amperage for use by the transmitter to transfer power to the receiver. These or other electrical components may be used to tune the transmitter to resonate at a particular operating frequency to transfer power wirelessly to the receiver of the downhole tool.

The components of the downhole tool may comprise one or more of processors, memory, sensors, heaters, cutters, drills, perforators, actuators, valves, motors, wheels, transceivers, communication modules, and electrical generators.

The downhole tool may comprise a processor to store one or more instructions and/or one or more preloaded instructions.

The processor may be configured to control the downhole tool to undertake the one or more instructions and/or the one or more preloaded instructions.

The processor may be configured to control the downhole tool autonomously. The processor may be configured to control the downhole tool based at least in part on one or more sensed downhole parameters.

According to another aspect of the disclosure a downhole tool for deployment within the wellbore is described.

The downhole tool may comprise: a battery for providing electrical power to one or more components of the downhole tool; and a receiver for providing electrical power to the battery, and for extracting or receiving electrical power from a transmitter of a lubricator comprising a housing for housing the downhole tool when in a stowed position.

The downhole tool may provide one or more of benefits or advantages described in respect of the described apparatus.

The receiver may be defined as a component able to extract, or receive electrical power from a transmitter. The transmitter and receiver form an electrical connection between them such that electrical power is transferred from the transmitter to the receiver.

The receiver comprising a mating electrical connector to allow electrical power to be transferred between the connectors. The receiver comprising a wireless power receiver for receiving or extracting electrical power transmitted or transferred from the transmitter.

The battery may provide power to an electric motor configured to propel the downhole tool. The battery may provide power to one or more sensors equipped on the downhole tool. Additional components powered by the battery may include heaters; communication modules for communicating data, i.e. receiving and/or receiving senor or control data; electric motors; valves; pumps; and processors.

The battery may include a series of batteries connected together to provide electrical power to components of the downhole tool.

The receiver may be co-planar with the transmitter when the downhole tool is in the stowed position. The receiver and transmitter may be in the same plane in the x-axis (horizontal axis) or in the y-axis (vertical axis). The receiver and transmitter may be co-axial such that the transmitter and receiver have the same central axis when the downhole tool is in the stowed position. Co-planar or co-axial transmitter and receiver may improve or increase electrical power transfer efficiency between the transmitter and receiver.

The downhole tool may comprise an alignment guide for aligning the transmitter of the lubricator with the receiver of the downhole tool. Aligning the transmitter and receiver may comprise positioning one or more of the receiver and transmitter such that electrical power transfer efficiency between the transmitter and receiver is optimized or maximized.

The stowed position may be predefined such that the downhole tool is in the same predefined position when it is housed in the lubricator in the stowed position. The predefined position may be selected to optimize electrical power transfer efficiency between the transmitter and receiver.

The downhole tool may comprise any of the feature or elements described in respect of the downhole tool of the apparatus.

According to another aspect a lubricator for fitting to a wellhead of a wellbore is provided.

The lubricator may be for fitting to a wellhead of the wellbore via a valve system providing communication between the lubricator and the wellbore. The lubricator may comprise a connected tubing sections.

The lubricator may be configured for housing a downhole tool when in a stowed position.

The lubricator may comprise: a transmitter for receiving electrical power from a remote power source, and for transferring received electrical power to a receiver of a downhole tool when in a stowed position for powering a battery of the downhole tool.

The lubricator may comprise any of the feature or elements described in respect of the lubricator of the apparatus.

According to another aspect a method a method of transferring power from a transmitter of a lubricator to a receiver of a downhole tool is provided.

The lubricator may be for fitting to a wellhead of a wellbore via a valve system providing communication between the lubricator and the wellbore. The lubricator may comprise connected tubing sections.

The lubricator may be configured for housing the downhole tool when in a stowed position.

The downhole tool may be configured for deployment within the wellbore.

The method may comprise: transferring, from a transmitter, electrical power to the receiver of the downhole tool.

Transferring electrical power may occur when the downhole tool is in a stowed position. The downhole tool may be received within a lubricator fitted to a wellhead of a wellbore via a valve system providing communication between the lubricator and the wellbore.

Transferring electrical power to the receiver of the downhole tool may allow for the downhole tool to remain within the lubricator and provide electrical power to the battery of the downhole tool, rather than remove the downhole tool from the lubricator to recharge the battery or replace the battery of the downhole tool. Removing the downhole tool from the lubricator may result in release of hazardous fluids within the lubricator which may have a detrimental impact on the environment. Further removing the downhole tool may increase the time and cost of conducting downhole operations.

Additionally the required personal and equipment required to provide power to the downhole tool may be reduced as the downhole tool need not be removed from the lubricator. Thus equipment and personal necessary to remove the downhole tool need not be required. This may reduce costs and time for providing electrical power to the downhole tool.

The method may further comprise stowing the downhole tool in a stowed position, in which the downhole tool is received within a lubricator fitted to a wellhead of a wellbore.

The method may further comprise receiving electrical power from the transmitter at the receiver for powering a battery of the downhole tool.

Transferring electrical power may comprise transferring electrical power via a connector of the transmitter and a corresponding connector of the receiver. The connectors may be configured to establish an electrical connection when the downhole tool is in the stowed position.

Transferring electrical power may comprise transferring electrical via wireless power transfer.

The method may further comprise controlling transferring the electrical power based on a parameter satisfying a threshold. The controlling may be performed by a controller. Satisfying the threshold may comprise a parameter meeting or exceeding a threshold.

The method may further comprise aligning the receiver with the transmitter. Aligning the receiver with the transmitter may optimize or maximize electrical power efficiency between the transmitter and receiver.

The method may further comprise deploying the downhole tool within the wellbore. Deploying the downhole tool within the wellbore may be lowering the downhole tool into the wellbore. The downhole tool may be lowered via a slickline.

The method may further comprise controlling deployment of the downhole tool based on a parameter satisfying a threshold.

The parameter may comprise a power level of the battery, a temperature of the battery, and a power transfer efficiency between the transmitter and receiver. For example, when the power level of the battery exceeds 80% the controller may deploy the downhole tool in the wellbore. When the power level of the battery does not exceed 80% the controller may not permit deployment of the downhole tool, but instead continue charging of the battery via electrical power transfer from the transmitter to the receiver until the battery exceeds 80%.

Deploying the downhole tool may comprise self-propelling the downhole tool. Self-propelling may comprise self-propelling the downhole tool into the wellbore and then self-propelling the downhole tool back from the wellbore to the stowed position.

According to another aspect there is provided a non-transitory computer readable medium having computer program code stored thereon, the code when executed by a processor performing the described method.

According to another aspect there is provided a computer program product comprising computer program code, the code when executed by a processor performing the described method.

It should be understood that any features described in relation to one aspect, example or embodiment of the disclosure may also be used in relation to any other aspect or embodiment of the disclosure.

Other advantages of the present disclosure will become apparent to one of skill in the art from the detailed description in association with the following drawings.

BRIEF DESCRIPTION OF THE DRAWINGS

A description is now given, by way of example only, with reference to the accompanying drawings, in which.

DETAILED DESCRIPTION OF THE INVENTION

Figure 1:
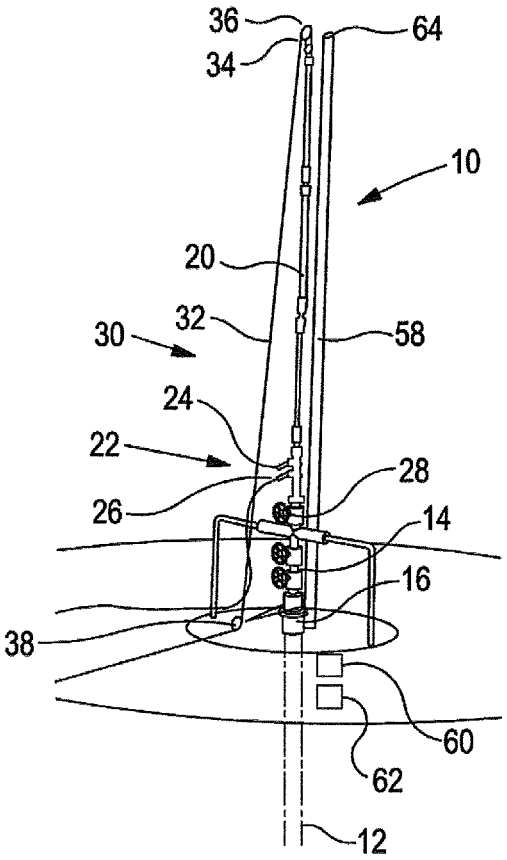
FIG. 1 is an isometric view of a wellhead with a lubricator fitted thereto.

The foregoing summary, as well as the following detailed description of certain embodiments will be better understood when read in conjunction with the accompanying drawings. As will be appreciated, like reference characters are used to refer to like elements throughout the description and drawings. As used herein, an element or feature recited in the singular and preceded by the word "a" or "an" should be understood as not necessarily excluding a plural of the elements or features. Further, references to "one example" or "one embodiment" are not intended to be interpreted as excluding the existence of additional examples or embodiments that also incorporate the recited elements or features of that one example or one embodiment. Moreover, unless explicitly stated to the contrary, examples or embodiments "comprising", "having" or "including" an element or feature or a plurality of elements or features having a particular property might further include additional elements or features not having that particular property. Also, it will be appreciated that the terms "comprises", "has" and "includes" mean "including but not limited to" and the terms "comprising", "having" and "including" have equivalent meanings.

As used herein, the term "and/or" can include any and all combinations of one or more of the associated listed elements or features.

It will be understood that when an element or feature is referred to as being "on", "attached" to, "connected" to, "coupled" with, "contacting", etc. another element or feature, that element or feature can be directly on, attached to, connected to, coupled with or contacting the other element or feature or intervening elements may also be present. In contrast, when an element or feature is referred to as being, for example, "directly on", "directly attached" to, "directly connected" to, "directly coupled" with or "directly contacting" another element of feature, there are no intervening elements or features present.

It will be understood that spatially relative terms, such as "under", "below", "lower", "over", "above", "upper", "front", "back" and the like, may be used herein for ease of describing the relationship of an element or feature to another element or feature as depicted in the figures. The spatially relative terms can, however, encompass different orientations in use or operation in addition to the orientation depicted in the figures.

Reference herein to "example" means that one or more feature, structure, element, component, characteristic and/or operational step described in connection with the example is included in at least one embodiment and or implementation of the subject matter according to the present disclosure. Thus, the phrases "an example," "another example," and similar language throughout the present disclosure may, but do not necessarily, refer to the same example. Further, the subject matter characterizing any one example may, but does not necessarily, include the subject matter characterizing any other example.

Reference herein to "configured" denotes an actual state of configuration that fundamentally ties the element or feature to the physical characteristics of the element or feature preceding the phrase "configured to".

Unless otherwise indicated, the terms "first," "second," etc. are used herein merely as labels, and are not intended to impose ordinal, positional, or hierarchical requirements on the items to which these terms refer. Moreover, reference to a "second" item does not require or preclude the existence of lower-numbered item (e.g., a "first" item) and/or a higher-numbered item (e.g., a "third" item).

As used herein, the terms "approximately" and "about" represent an amount close to the stated amount that still performs the desired function or achieves the desired result. For example, the terms "approximately" and "about" may refer to an amount that is within less than 10% of, within less than 5% of, within less than 1% of, within less than 0.1% of, or within less than 0.01% of the stated amount.

Use of the word "exemplary", unless otherwise stated, means 'by way of example' or 'one example of', and does not mean a preferred or optimal design, configuration, or implementation.

Turning now to FIG. 1 apparatus (e.g. an intervention system) 10 configured to perform an intervention operation in a wellbore 12 is shown. In the illustrated arrangement, the wellbore 12 is land-based having a wellhead valve arrangement in the form of a Christmas tree 14 disposed on a wellhead 16.

The intervention system 10 is configured to deploy an intervention or downhole tool into the wellbore 12. While not depicted in the illustrated arrangement, the intervention tool comprises a paraffin wax removal tool for cleaning paraffin deposits from the wellbore 12 and associated infrastructure and equipment. However, it will be recognized that the intervention system 10 may be configurable to perform a number of different intervention operations using a suitable intervention tool. Further, the intervention tool may be deployed on a slickline or wireline through a stuffing box as will be described.

As shown in FIG. 1, the intervention system 10 comprises a tool housing in the form of a lubricator 20. In the illustrated arrangement, the lubricator 20 comprises a stand of three connected heavy wall tubing sections, the interior of the lubricator 20 defining a tool storage compartment configured to house the intervention tool.

As shown in FIG. 1, the lubricator 20 is coupled to and disposed on top of the Christmas tree 14. The lubricator 20 is fitted to the wellhead via a valve system 22, which in the illustrated arrangement forms part of the lubricator 20. The valve system may also include the Christmas tree 14. The valve system 22 permits selective communication of tools and fluid between the lubricator 20 and the wellbore 12.

The exemplary valve system 22 shown has an upper control valve 24 and a lower control valve 26, which can be controlled independently. The valve system 22 provides a dual barrier between the lubricator 20 and the wellhead valve arrangement 14, and permits an upper valve 28 of the Christmas tree 14 to be maintained in an open condition.

The intervention system 10 is configurable between a tool stowed configuration in which the lubricator 20 is isolated from the wellbore 12 by the valve system 22 and an activated configuration in which the valve system 22 is open and the lubricator 20 communicates with the Christmas tree 14 and/or the wellbore 12 to permit deployment of the intervention tool by a tool deployment arrangement 30, as will be described below.

In the tool stowed configuration, the intervention tool may be positioned in the lubricator in a stowed position. In the activated configuration the intervention tool may move from the stowed position to a position downhole of the lubricator as the tool descends into the wellbore. The tool may then return having completed a downhole operation to the stowed position. The intervention system 10 may then be configured into the tool stowed configuration again.

The tool deployment arrangement 30 is provided for deploying the intervention tool into the wellbore 12. The tool deployment arrangement 30 comprises a conveyance in the form of slickline or wireline 32 which is coupled to the intervention tool and which extends through an upper end portion of the lubricator 20 via stuffing box 34—in the illustrated arrangement a dual chamber stuffing box—to ensure pressure integrity of the lubricator 20 and monitor any fluid/gas wire bypass.

The tool deployment arrangement 30 further comprises sheaves or pulleys 36, 38 for supporting the wireline 32. In the illustrated arrangement shown in FIG. 1, pulley 36 is disposed on the lubricator 20 above the stuffing box 34 and pulley 38 is tied to wellhead 16, although it will be recognized that the pulleys 36, 38 may be disposed at other suitable locations.

In some arrangements, a monitoring arrangement is provided, as illustrated in FIG. 1. The exemplary monitoring arrangement comprises a flow sensor 60 and a pressure sensor 62. However, it will be recognized that in other arrangements the monitoring arrangement may comprise one or other of the flow sensor 60 and the pressure sensor 62, or other sensors alone or in combination. The monitoring arrangement also comprises a visual monitoring system in the form of a camera 64 which in the illustrated arrangement is disposed on the support mast 58. In use, the camera 64 may facilitate remote visual monitoring of the tool deployment arrangement.

Figure 2:
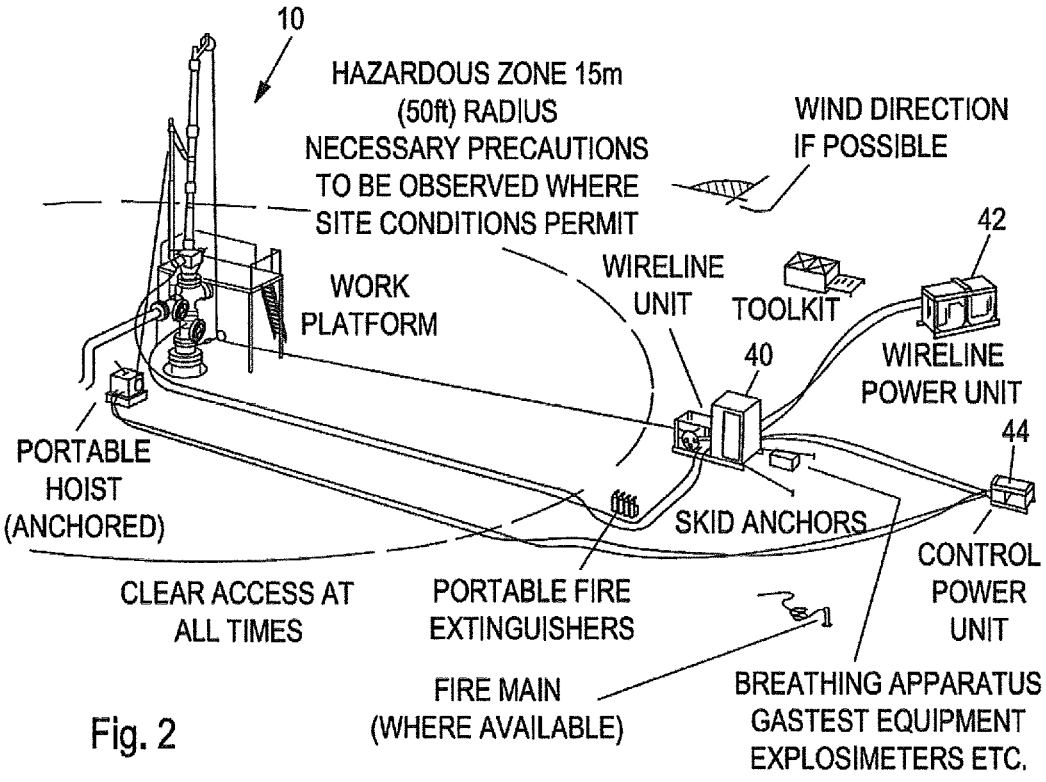
FIG. 2 shows an isometric view of a wellhead with a lubricator fitted thereto along with a plurality of remote units.

FIG. 2 shows an exemplary setup of an intervention apparatus or system at a wellhead. The Christmas tree, lubricator and valve system arrangement of FIG. 2 may be the same or similar to that of FIG. 1. A winch is provided as part of a wireline unit 40 and is operatively coupled to a drive which in the illustrated arrangement takes the form of a direct drive electric motor. In use, the drive rotates the winch in order to pay out the wireline 32 when it is desired to deploy the intervention tool 18 into the wellbore 12, and to reel in the wireline 32 when it is desired to retrieve the intervention tool from the wellbore 12. That is, the tool is deployed and retrieved using the wireline. In addition, weight bars may be positioned on the tool to drive it into the wellbore 12 when the wireline 32 is paid out. The weight bars take up considerable space in the lubricator 20.

As shown in FIG. 2, the illustrated arrangement of an intervention apparatus further comprises a wireline power unit 42, a control power unit 44 and other ancillary equipment.

In FIG. 1 (and similarly in FIG. 2) a support arrangement in the form of support mast 58 supports the Christmas tree 14 and the lubricator 20.

In some arrangements, the intervention tool may be deployed into the wellbore 12 via a slickline. The lubricator 20 may include a transmitter for transferring electrical power. The intervention tool may include a receiver for receiving or extracting electrical power from the transmitter when the tool in a stowed position in the lubricator 20. The receiver may provide the received electrical power to a battery of the tool to power one or more components of the downhole tool. The battery of the tool may thus be provided with electrical power without removing the tool from the lubricator 20 to recharge or replace the battery once electrical power is depleted from the battery. This may reduce operation times and therefore reduce costs. Further, this may improve autonomy of the intervention operation as additional components may control electrical power transfer between the transmitter and receiver. Accordingly, this improved autonomy may reduce the number of staff, vehicles, equipment, etc. present at the wellbore 12 site. This may reduce costs and environmental impact of the operation.

Figure 3A:
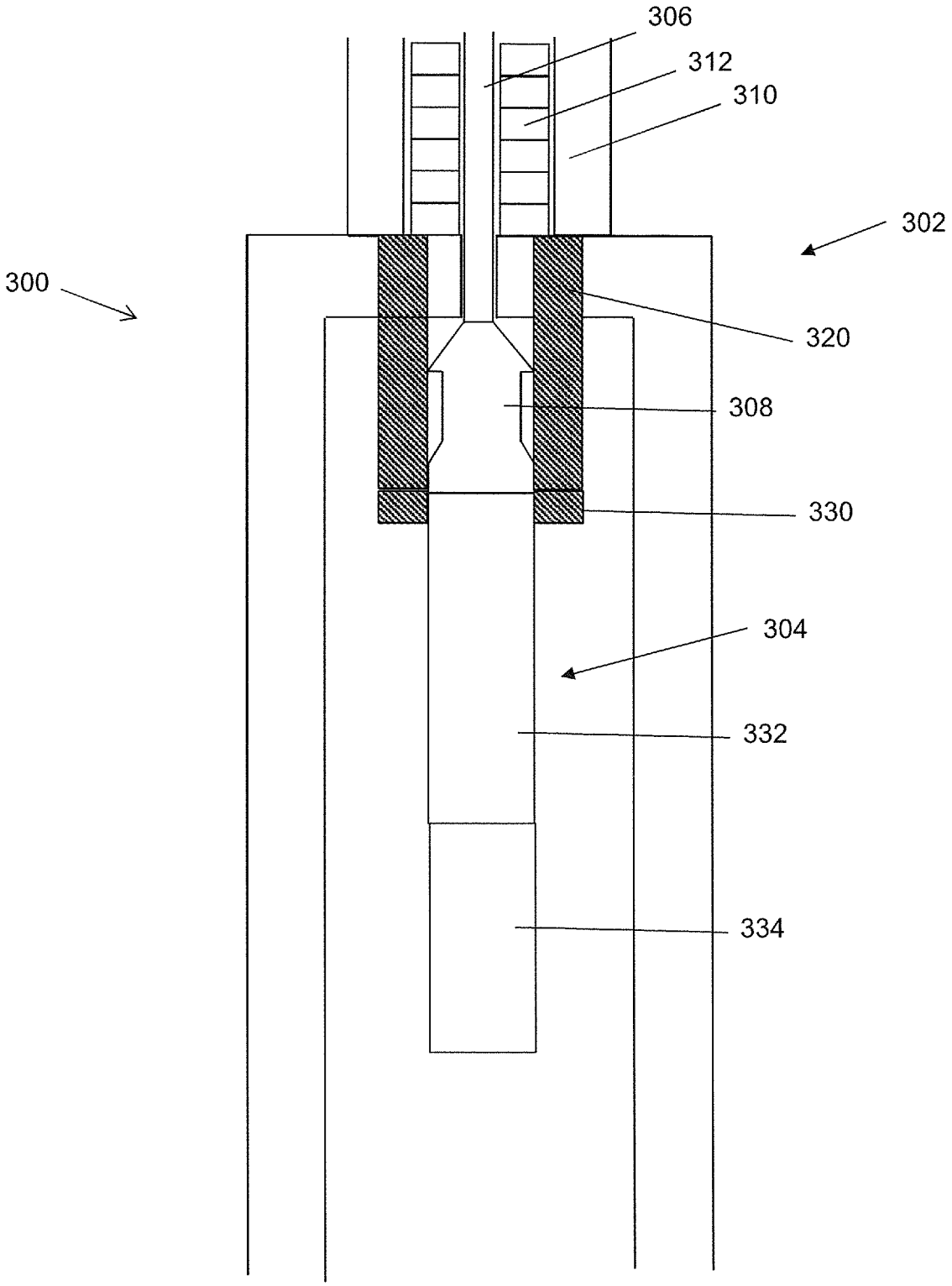
FIG. 3A shows a section through a lubricator with a downhole tool within the lubricator in a stowed position.
Figure 3B:
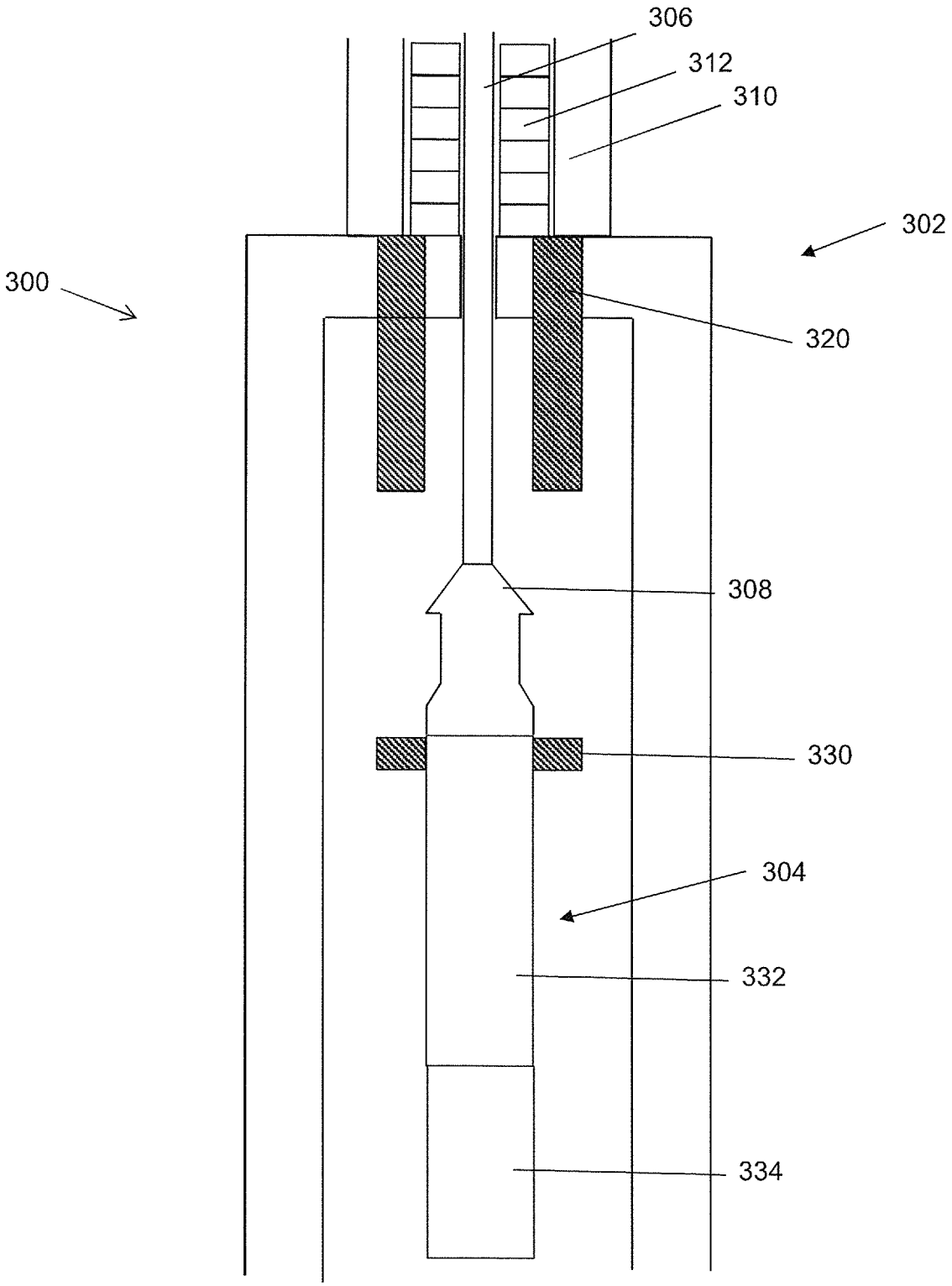
FIG. 3B shows a section through a lubricator with a downhole tool within the lubricator in a deployed position.

FIGS. 3A and 3B show an apparatus 300 for fitting to a wellbore. In the illustrated arrangement, the apparatus 300 comprises a lubricator 302 for fitting to a wellhead of a wellbore, such as the wellbore 12. The apparatus 300 further comprises a downhole or intervention tool 304 for deployment within the wellbore. The tool 304 is within the lubricator 302.

In the illustrated arrangement, the tool 304 is deployed via a conveyance which is in the form of a wireline or slickline 306. The wireline 306 is coupled to the intervention tool 304 via a rope socket 308. An exemplary rope socket 308 is a pear drop slickline rope socket provided by Hunting™ although one of skill in the art will appreciate other rope sockets are possible.

The wireline 306 extends from a wireline unit which includes a winch, such as the described wireline unit 40. The wireline 306 extends through an upper portion of the lubricator 302 via a stuffing box 310 to ensure pressure integrity of the lubricator 302. In the illustrated arrangement the stuffing box 310 has packing rings 312 disposed therein.

The wireline 306 may be used to deploy the tool 304 into the wellbore. As shown in FIG. 3*a*, the lubricator 302 is configured to house the tool 304 when it is stowed, i.e., in a stowed position in the lubricator 302. That is, the lubricator 302 is configured to house the downhole tool 304 before deployment and/or after completion of a task or operation, such as an intervention operation.

As in FIGS. 1 and 2, a valve system may provide communication between a Christmas tree and/or a wellbore, and the lubricator 302, which may be fitted to a distal end of the valve system. Communication between the lubricator 302 and the Christmas tree may be fluid communication and/or communication allowing the downhole tool 304 to pass from the lubricator 302 to the wellbore and/or from the wellbore to the lubricator 302.

As used herein, the term "distal" encompasses a feature of an apparatus that is positioned further away from the wellbore. The term "proximal" encompasses a feature that is positioned closer to the wellbore. For example, a valve system may be generally elongate and has a proximal end fitted to a Christmas tree and a distal end fitted to the lubricator 302.

The lubricator 302 comprises a transmitter which in the illustrated arrangement takes the form of a connector 320. The transmitter is for transferring electrical power to the downhole tool 304. The connector 320 establishes an electrical connection with a connector of the downhole tool 304 to provide electrical power to the tool 304 as will be described. The connector 320 mates with a connector on the downhole tool 304 as will be described when the tool 304 is in the stowed position as shown in FIG. 3A.

The connector 320 of the lubricator 302 is generally elongate. As shown in FIGS. 3A and 3B, the connector 320 extends into the interior volume of the lubricator 302. The connector 320 may thus define an alignment guide for aligning the downhole tool 304 such that electrical power efficiency between the connectors 320, 330 is maximized when the tool 304 is in the stowed position.

The connector 320 is connected to an electrical cable (not shown) external to the lubricator 302. The electrical cable provides a power signal to the connector 320 via a remote power source. The power source may be a renewable power source such as wind turbine or solar panel, a generator, or grid supply. The electrical cable is secured to the connector 320 on an external side of the lubricator to form a seal such that fluid may not exit the interior volume of the lubricator.

The downhole tool 304 comprises a battery 332, a downhole component 334, and a receiver which in the illustrated arrangement takes the form of a connector 330. The battery 332 is for providing electrical power to the downhole component 334. The downhole component 334 may comprise a number of components to complete the required downhole or intervention operation. For example, the downhole component 334 may comprise a wax removal tool for the removal of paraffin wax build-up.

The connector 330 is electrically connected to the battery 332 such that electrical power received by the connector 330 is provided to the battery 332. In other words, the connector 330 may be used to charge the battery 332 when the battery is at least partially depleted.

On an internal side of the lubricator 302, i.e. within the inner volume of the lubricator 302, the connector 330 of the downhole tool 304 electrically connects to the connector 320 of the lubricator 302 when the downhole tool 304 is in the stowed position. Electrical power is transferred from the connector 320 (transmitter) to the connector 330 (receiver) via this electrical connection. The electrical connection may be a physical connection between the connectors 320, 330 to transfer electrical power. The connectors 320, 330 may be wet-mate connectors.

The apparatus further comprises a controller (not shown) for controlling electrical power transfer between the transmitter and receiver and deployment of the downhole tool 304. One of skill in the art will appreciate, the controller may solely control deployment of the downhole tool 304. The controller receive one or more sensed parameters and controls power transfer/deployment based on the sensed parameters. In the illustrated arrangement, the controller receives a power level of the battery 332 of the downhole tool 304. If the power level is below a threshold level, e.g. 80%, the controller controls the transmitter to transfer electrical power to the receiver when the downhole tool 304 is in the stowed position.

The controller may comprise a processor for processing received sensed parameters and a memory for storing data such as the received sensed parameters. The controller may further comprise a communication module for communicating with the downhole tool 304 and the transmitter.

Controlling the transmitter to transfer electrical power may comprise one or more electrical components such as switches, switchgear, transistors, MOSFETs, etc.

Controlling deployment of the downhole tool may comprise controlling operation of a winch to which the wireline 306 is connected.

The controller can instruct the downhole tool to return to the stowed position once an operation is complete.

In use, the downhole tool 304 may initially be deployed in the stowed position such that electrical power is transferred to the receiver from the transmitter as shown in FIG. 3A. When sufficient electrical power is transferred, i.e. once the battery 332 is sufficiently charged, the controller may deploy the downhole tool 304 via operation of a winch to which the wireline 306 is connected. The downhole tool 304 is depicted as being deployed for a downhole or intervention operation in FIG. 3B.

The downhole tool 304 may then perform a downhole operation utilizing the downhole component 334, e.g. removing wax from the wellbore 12. Once in the stowed position within the lubricator 302, the transmitter may then transfer electrical power to the receiver via the electrical connection between the connectors 320, 330. The battery 332 may then be recharged such that the tool 304 can be re-deployed for another operation. The controller may control electrical power transfer.

This process may be automated such that no personnel are required onsite, i.e. at the wellbore 12, to deploy to tool 304 and to charge the battery 332 of the tool 304. This may reduce costs, intervention times, lost production time, and environmental impacts.

While a particular arrangement of the apparatus 300 has been described in which the transmitter transfers power to the receiver via physical connection between the transmitter and receiver, other arrangement are possible. In other arrangements shown in FIGS. 4A and 4B, the electrical power between the transmitter and receiver is wireless.

In these arrangements, an apparatus 400 similar to the apparatus 300 is illustrated. Like components of the apparatus 400 to those of the apparatus 300 are represented by like numerals incremented by 100.

In the illustrated arrangements, the apparatus 400 comprises a lubricator 402 comprising a transmitter comprising a wireless power transmitter 440, and a downhole tool 404 comprising a receiver comprising a wireless power receiver 442. The wireless power transmitter 440 is configured to transfer electrical power to the wireless power receiver 442 wirelessly.

Figure 4A:
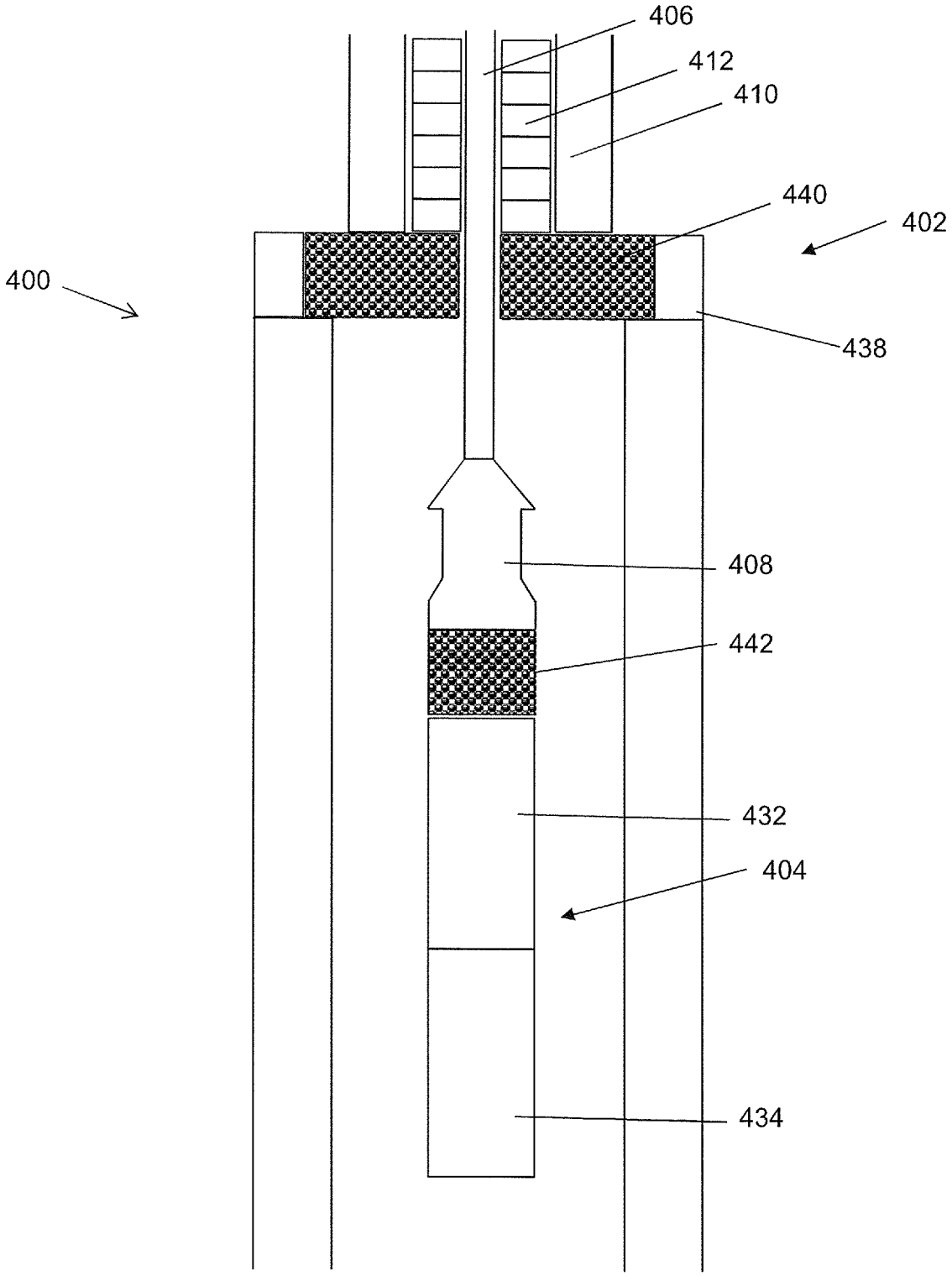
FIG. 4A shows a section through a lubricator with a downhole tool within the lubricator in a deployed position.

In the arrangement illustrated in FIG. 4A, the downhole tool 404 is shown in a deployed position, i.e., not in the stowed position. Upon returning to the stowed position, the wireless power transmitter 440 is configured to transfer power to the wireless power receiver 442 wirelessly.

The wireless power transmitter 440 form a portion of the top wall of a housing 438 of the lubricator 402. The housing 402 houses the downhole tool 404. Specifically, the housing 438 defines an interior volume in which the downhole tool 404 is housed. As with the connector 320, the transmitter 440 is connected to a remote power source. The power source provides a power signal to the transmitter 440. In the illustrated arrangement the transmitter 440 takes the form of an inductive coil for transferring electrical power via magnetic field inductive coupling.

Similarly, the receiver 442 comprises an inductive coil for extracting or receiving electrical power via magnetic field inductive coupling. The receiver 442 is electrically connected to the battery 432 such that extracted electrical power charges the battery 432.

While the transmitter 440 and receiver 442 are described as comprising inductive coil, they may alternatively or additionally comprise a capacitive electrode for transferring/receiving electrical power via electric field capacitive coupling.

Further the transmitter 440 and receiver 442 may comprise one or more of a power converter, transformer, tuning network, and rectifier for processing a power signal for transmission or charging the battery 432.

In the arrangement illustrated in FIG. 4A, the transmitter 440 and receiver 442 are positioned such that the rope socket 408 is between these components when the downhole tool 404 is in the stowed position. As such the rope socket 408 may negatively impact wireless power transfer efficiency between the transmitter 440 and receiver 442.

Figure 4B:
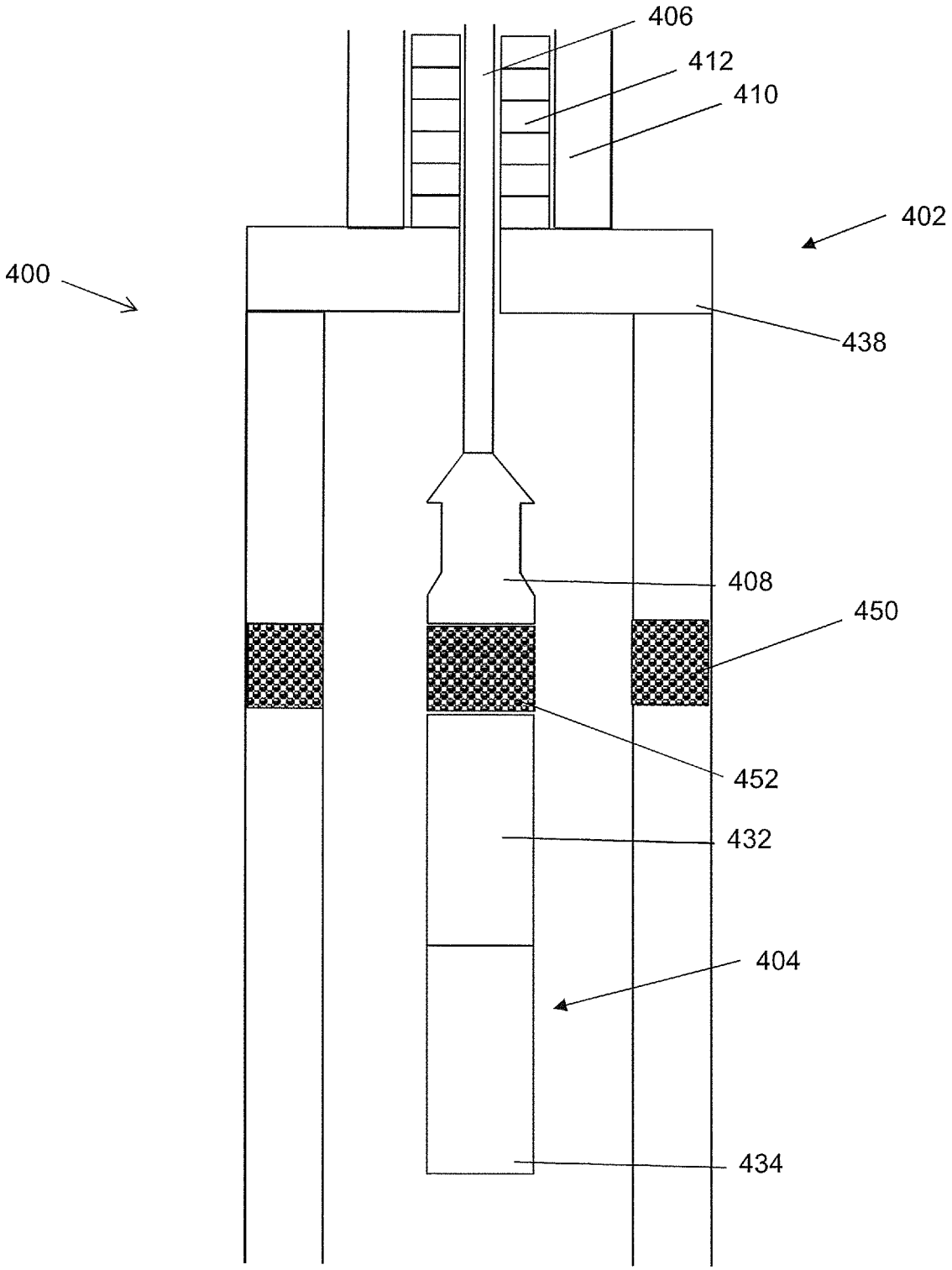
FIG. 4B shows a section through a lubricator with a downhole tool within the lubricator in a stowed position.

Turning now to FIG. 4B, another arrangement of the apparatus 400 is shown. In this arrangement the transmitter comprises a wireless power transmitter 450 formed in a sidewall of the housing 438 of the lubricator 402. The receiver comprises a wireless power receiver 452 electrically connected to the battery 432 of the downhole tool 404. As with the transmitter 440 and receiver 442, the transmitter 450 and receiver 452 may comprise an inductive coil or a capacitive electrode to transfer power via magnetic field inductive or electric field capacitive coupling, respectively.

In the illustrated arrangement, the transmitter 450 is formed in a portion of the sidewall of the housing 438 of the lubricator 402 rather than the top or upper wall. In this arrangement, the rope socket 408 is not between the transmitter 450 and receiver 452 when the downhole tool 404 is in the stowed position. As such the rope socket does not negatively impact power transfer efficiency between the transmitter 450 and receiver 452.

The downhole tool 404 and/or lubricator 402 may comprise an alignment guide to ensure the receiver 452 and transmitter 450 are aligned to maximize wireless power transfer efficiency.

In some arrangements, the intervention tool may form part of a self-propelled downhole tool for use in the wellbore 12. The self-propelled downhole tool may be configured to drive itself into the wellbore, powered by one or more motors. The one or more motors may be electric motors and may be provided with electrical power via a power supply similar to that shown in FIG. 2. The self-propelled downhole tool may comprise a plurality of drive wheels. The drive wheels may be extendable on arms from a main body of the self-propelled downhole tool to engage an inner wall of the wellbore (or production tubing or casing). The drive wheels may be electrically or hydraulically driven.

Figure 5A:
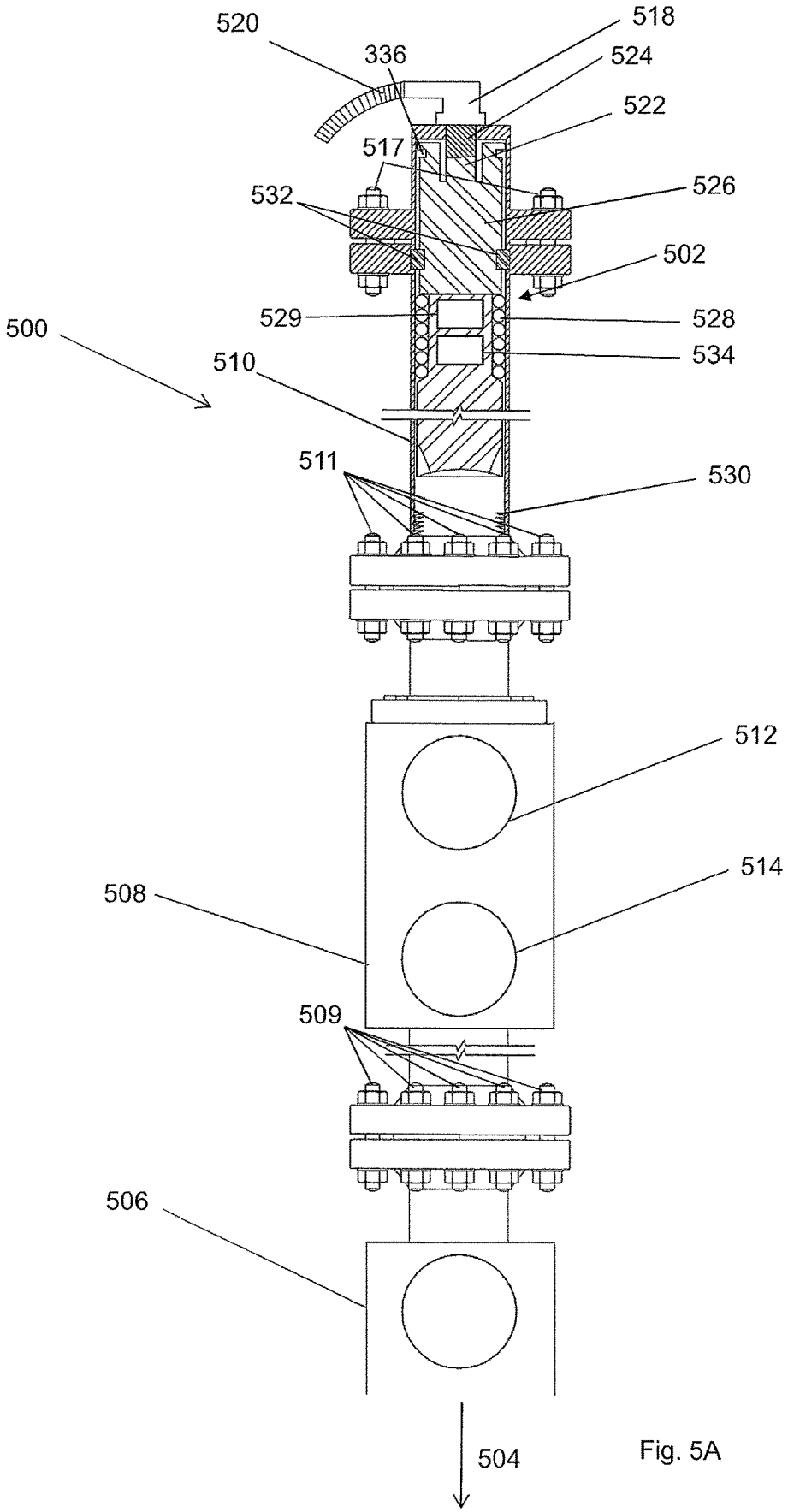
FIG. 5A shows a section through part of a wellhead including a self-propelled downhole tool stowed within a lubricator.
Figure 5B:
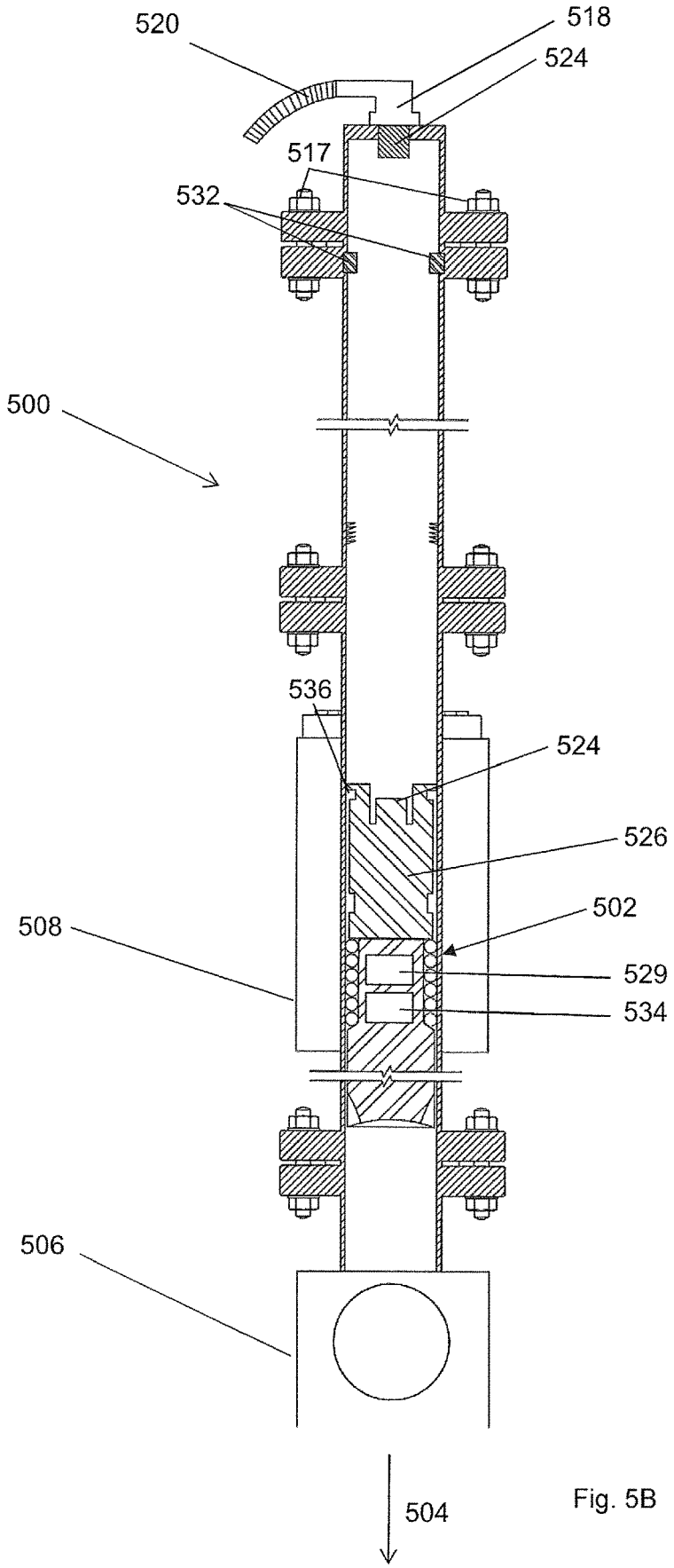
FIG. 5B shows a section through part of a wellhead including a self-propelled downhole tool during deployment.

FIGS. 5A and 5B show an apparatus 500 for deploying a self-propelled downhole tool 502 into a wellbore 504. In the example of FIGS. 5A and 5B, the self-propelled downhole tool 502 is not deployed on a slickline or wireline. The self-propelled downhole tool 502 is configured to operate autonomously.

As used herein, the term "autonomous" in respect of operation of the self-propelled downhole tool 502 encompasses a self-propelled downhole tool that is instructed to deploy and undertake a task, and then requires no further instruction during that task in order to complete it. Completion of the task may include the self-propelled downhole tool returning to a start position, such as the stowed position. In some arrangements, an autonomous self-propelled downhole tool may also require no power (e.g. electrical power and/or hydraulic power) after deployment in order to complete the task. Accordingly, the self-propelled downhole tool may be configured, after deployment, to have no direct connection to any remote unit providing instructions to the self-propelled downhole tool. Direct connection in this context encompasses any communication of instructions, electrical power and/or hydraulic power to the self-propelled downhole tool from a remote unit via a physical medium, such as a wireline or slickline. The downhole tool 502 may also gather data using sensors and use that gathered data for control of the tool 502 without assistance from other apparatus outside the wellbore 504, e.g. from surface.

FIG. 5A shows a top part of a Christmas tree 506, however a Christmas tree need not be used in all arrangements. Below the Christmas tree 506 and not shown in FIG. 5A is the wellbore 504.

A valve system 508 is fitted to the Christmas tree 506 by a plurality of bolts 509, although other fixings may be used. As in FIGS. 1 and 2, the valve system 508 provides communication between the Christmas tree 506 and/or the wellbore 504, and a lubricator 510, which is fitted to a distal end of the valve system 508. The lubricator 510 is fitted to the valve system 508 by a plurality of bolts 511, although other fixings may be used. Communication between the lubricator 510 and the Christmas tree 506 may be fluid communication and/or communication allowing the self-propelled downhole tool 502 to pass from the lubricator 510 to the wellbore 504 and/or from the wellbore 504 to the lubricator 510. As in FIGS. 1 and 2, the valve system 508 comprises an upper valve 512 and a lower valve 514 that are controllable independently. In some arrangements, the valve system 508 may form part of the lubricator 510. In some arrangements, the valve system 508 may comprise a different number of valves, for example 1 or 3 valves. The Christmas tree may form part of the valve system 508.

An end cap 516 is fitted to a distal end of the lubricator 510 by a plurality of bolts 517, although other fixings may be used. The end cap 516 is sealed. The end cap 516 comprises static features that form the seal. That is, the end cap 516 does not include a stuffing box or any mechanism through which a slickline or wireline can be passed and which a seal must be formed around. The end cap 516 comprises an input port 518 through which electrical power may be received. The input port 518 forms a transmitter for transferring power to a receiver of the tool 502.

In the illustrated arrangement, the input port 518 comprises an electrical connector configured to be connected to an external cable 520. The electrical connector is secured to the end cap 516 so as to form a seal. The external cable 520 may be further connected to one or more remote units (not shown). The one or more remote units may be configured to supply electrical power to the apparatus 500 via the external cable 520. In other arrangements, the input port 518 may comprise one or more wireless communications devices. In some arrangements, the one or more wireless communications devices may be positioned elsewhere within the apparatus 500.

The lubricator 510 is configured to house the self-propelled downhole tool 502 when it is stowed. That is, the lubricator 510 is configured to house the self-propelled downhole tool 502 before deployment and/or after completion of a task or operation, such as an intervention operation. The tool 502 is shown in the stowed position in FIG. 5A and in a deployed position in FIG. 5B.

The self-propelled downhole tool 502 may further comprise an electrical connector 522 that is configured for electrical connection to the input port 518. The input port 518 may comprise an electrical connector 524, which is configured to electrically connect with the electrical connector 522 of the self-propelled downhole tool 502.

Accordingly, an electrical connection may be established between the input port 518 and the self-propelled downhole tool 502. The lubricator 510, and in the specific arrangement of FIG. 5A, the input port 518, is able to electrical power from one or more remote units (not shown) and pass the electrical power to the self-propelled downhole tool 502 via the connectors 522, 524 which form the electrical connection. The connector 522 may thus form a receiver for receiving electrical power from the transmitter, i.e. the input port and connector 524.

In the example shown, the electrical connection is provided by the electrical connectors 522, 524 although other arrangements, e.g. a wireless data link, may be used.

The input port 518 and connectors 522, 524 may additionally provide data communications for operation of the self-propelled downhole tool 502, as explained below.

The self-propelled downhole tool 502 may comprise a battery pack 526, which is configured to receive electrical power from the one or more remote units via and store it. When the self-propelled downhole tool 502 is in the stowed position and electrical communication between the input port 518 and the self-propelled downhole tool 502 is established, the battery pack 526 may be configured to receive electrical power from the one or more remote units to charge it. The self-propelled downhole tool 502 may also comprise a memory 529 configured to store data received in the data communications from the one or more remote units. When the self-propelled downhole tool 502 is in the stowed position, the data communications may be transferred to the memory 529 of the self-propelled downhole tool 502 over the electrical connection via the input port 518.

The lubricator 510 may include one or more cleaning apparatus 530. The cleaning apparatus 530 may be positioned at a point in the lubricator 510 such that the self-propelled downhole tool 502 must pass the cleaning apparatus 530 when being deployed and/or when returning to the stowed position after deployment. That is, the cleaning apparatus 530 may be positioned at a more proximal location than the self-propelled downhole tool 502 when the self-propelled downhole tool 502 is in the stowed position. The cleaning apparatus may comprise one or more brushes or scrapers.

The lubricator 510 may have a reduced length over known lubricators. For example, the lubricator 510 may be short enough to fit between two decks of an offshore rig. This is possible at least partly because the weight bars used for known tool deployments are not required in exemplary arrangements disclosed herein, as deployment is made possible by the self-propulsion system of the downhole tool.

FIG. 5A shows the self-propelled downhole tool 502 in the stowed position and received within the lubricator 510. The self-propelled downhole tool 502 is configured to propel itself along at least part of a length of the wellbore 504. That is, the self-propelled downhole tool 502 may propel itself along the wellbore 504 without receiving further electrical power and/or data communications from a remote unit during at least part of a time period when it is deployed. Accordingly, the self-propelled downhole tool 502 comprises a drive mechanism. The drive mechanism may comprise a motor. The drive mechanism may comprise one or more wheels 528 and/or caterpillar tracks, for example (although other means for propelling the self-propelled downhole tool will be clear to the skilled person). The motor may be an electric motor and may be powered by the battery pack 526. The motor may be configured to drive the one or more wheels 528, caterpillar tracks or other means. Further, the wheels 528, caterpillar tracks or other means may be positioned on arms extendable from a main body of the self-propelled downhole tool 502. The arms may extend until the wheels 528, caterpillar tracks or other means are in contact with a sidewall of the wellbore, which may comprise tubing, casing or an open hole.

The self-propelled downhole tool 502 may comprise docking features that engage with corresponding docking features 532 on the lubricator 510. The docking features 532 are arranged to retain the self-propelled downhole tool 502 in the lubricator 510 when stowed. Accordingly, the docking features 532 may comprise one or more detent mechanisms. The skilled person will be aware of a number of detent mechanisms and any may be used.

As mentioned above, the self-propelled downhole tool 502 may comprise an electrical terminal 522 that is configured to communicate electrically with a corresponding electrical terminal 524 on the input port 518. When the self-propelled downhole tool 502 is stowed, the electrical terminal 522 of the self-propelled downhole tool 502 is able to communicate with the electrical terminal 524 of the input port 518. The electrical terminals 522, 524 may comprise electrical connectors configured to engage, antennas configured to communicate wirelessly, or another type of electrical terminal. The transfer of electrical power and/or data communications to the self-propelled downhole tool 502 may be via the electrical communication provided by the electrical terminals 522, 524.

In exemplary arrangements, the electrical terminals 522, 524 may form at least part of the docking features and/or detent mechanism. That is, the docking features may form an electrical connection between the self-propelled downhole tool 502 and the input port 518 and/or may control at least partly operation of the electrical terminals 522, 524 when the self-propelled downhole tool 502 is stowed. In exemplary arrangements, the electrical communication between the self-propelled downhole tool 502 and the input port 518 (or lubricator 510) is broken after deployment of the self-propelled downhole tool 502, e.g. after the detent mechanism is overcome.

As mentioned above, the self-propelled downhole tool 502 may comprise a battery pack 526. The battery pack 526 of the self-propelled downhole tool 502 may be charged by the electrical power received from the remote unit and passed to the self-propelled downhole tool 502 via the electrical terminals 522, 524. The battery pack 526 of the self-propelled downhole tool 502 may provide electrical power to the motor to drive the wheels 528, caterpillar tracks or other drive means, and/or to any sensors or other electrical equipment fitted to the self-propelled downhole tool 502.

The self-propelled downhole tool 502 may also comprise a processor 534. The processor 534 may be configured to control operation of one or more tools on the self-propelled downhole tool 502. For example, the self-propelled downhole tool 502 may include one or more of a camera, a temperature sensor, a pressure sensor or any other tool used in downhole operations. In a specific arrangement, the self-propelled downhole tool 502 may include a wax removal tool for the removal of paraffin wax build-up. The processor may also be configured to control the drive mechanism of the self-propelled downhole tool 502.

More specifically, the processor 534 may be configured to receive data communications from the lubricator 510, which may be via the input port 518, and to store the data in a memory for use during deployment to control the self-propelled downhole tool 502 and/or one or more tools located on the self-propelled downhole tool 502.

The processor 534 may be configured to receive data from the described monitoring arrangement. The monitoring arrangement may sense data, such as flow rate and/or pressure and provide the sensed data to the remote unit and/or the processor 534. The processor 534 and/or the remote unit may use the sensed data to determine instructions setting one or more deployment parameters, as discussed above.

In some arrangements, the memory 529 may be configured to store data relating to one or more downhole parameters and sensed by the one or more sensors on the self-propelled downhole tool 502, such as a camera, a temperature sensor, a pressure sensor. When the self-propelled downhole tool 502 is in the stowed position and electrical communication is established with the input port 518, the self-propelled downhole tool 502 may transmit the stored sensor data to the one or more remote units. The data communications received from the remote unit may be based on the transmitted sensor data. In other arrangements, the processor 534 may be configured to determine one or more instructions for operating the self-propelled downhole tool 502 based on the sensor data. For example, during deployment the one or more sensors may measure an internal diameter of a casing or tubing of the wellbore 704. If the diameter is found not to be as expected in a particular area, the processor 534 of the self-propelled downhole tool 502 (and/or the remote unit if the sensed diameter is transmitted thereto) may determine that more wax cleaning (e.g. greater time) should be focused on that area. This may be done by the processor 534 without human intervention and/or the intervention of apparatus outside of the wellbore 504.

The processor 534 may be configured to control the self-propelled downhole tool 502 autonomously, e.g. without receiving any further data or instruction from the lubricator 510 or the remote unit for at least part of the period of deployment.

In specific arrangements, the self-propelled downhole tool 502 may be configured to undertake one or more well intervention or workover tasks. For example, the self-propelled downhole tool 502 may be configured deploy within the well bore and the paraffin wax removal tool may remove paraffin wax deposits from the wellbore 12 and associated infrastructure and equipment.

In the exemplary arrangement shown in FIG. 5A, the self-propelled downhole tool 502 also comprises a fishing neck 536 for removal of the self-propelled downhole tool dock 522 and self-propelled downhole tool 502 using a fishing tool, if necessary.

FIG. 5B shows the system of FIG. 5A with the self-propelled downhole tool 502 shortly after deployment. In other words, the downhole tool 502 is no longer in the stowed position.

In exemplary arrangements, the self-propelled downhole tool 502 may be configured to transmit data (e.g. sensor data) to surface and/or to receive data from surface using, at least in part, wireless EM communication and/or wireless acoustic communication.

Figure 6:
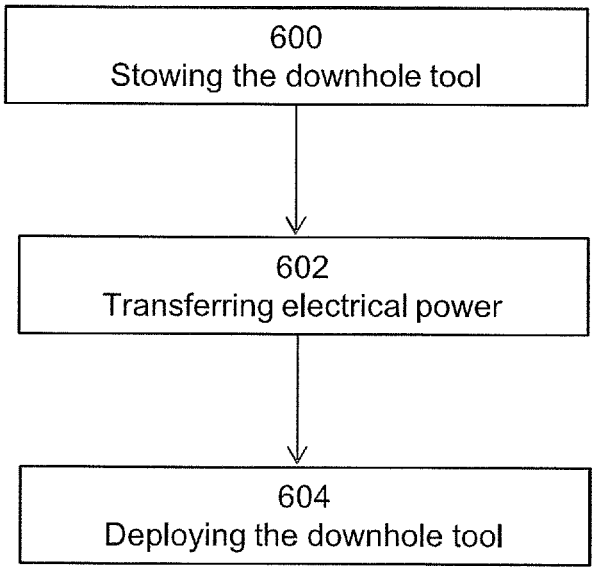
FIG. 6 is a flow diagram of a method for transferring power from a transmitter of a lubricator to a receiver of a downhole tool.

FIG. 6 is a flow diagram of a method of operating a downhole such as the downhole tool 304 or 404. The downhole tool may be the self-propelled downhole tool 502. The self-propelled downhole tool 502 is configured to propel itself along at least a part of the length of the wellbore 504.

The method comprises stowing 600 the downhole tool in a stowed position. This may comprise docketing the downhole tool in a lubricator, e.g. lubricator 302, 402 or 510, using the features discussed above. For example, in stowing the self-propelled downhole tool 502, the docking feature of the self-propelled downhole tool 502 may engage with the corresponding docking features 532 of the lubricator 510. The detent mechanism may be engaged.

In the stowed position electrical power transfer is possible between the transmitter of the lubricator and the receiver of the downhole tool. For example, electrical power transfer is possible via the electrical connection between connectors 320 and 320. In another example, electrical power transfer is possible between wirelessly via wireless power transmitter 440, 450 and wireless power receiver 442, 452, respectively.

In another example, electrical power transfer is possible between the input port 518 and the self-propelled downhole tool 502 by way of the electrical terminals. In exemplary arrangements, the electrical terminals comprise electrical connectors 522 on the self-propelled downhole tool 502 that are configured to engage with electrical connectors 524 on the input port 518.

In this configuration, the upper and lower control valves 512, 514 may be in their closed configurations, thereby providing a dual barrier between the lubricator 510 and the Christmas tree 506/wellbore 504. The provision of the dual barrier beneficially permits the upper control valve of the Christmas tree 506 to be maintained in an open configuration.

The method further comprises transferring 602 electrical power from the transmitter to the receiver. Electrical power is transferred when the downhole tool is in the stowed position in the lubricator. Transferring 602 electrical power charges the battery of the downhole tool. The electrical power is provided by one or more remote units, e.g. power sources.

The method further comprises deploying 604 the downhole tool. Deploying the downhole tool may comprise the downhole tool self-propelling into the wellbore, or operating a winch to deploy the downhole tool into the wellbore via a wireline or slickline.

The downhole tool may be deployed to complete one or more downhole or intervention operations.

It should be understood that embodiments described herein are merely exemplary and that various modifications may be made thereto without departing from the scope of the disclosure.

For example, while in the described embodiments the systems and methods are directed to the removal of paraffin wax from a wellbore and associated infrastructure and equipment, it will be understood that the systems and methods may be used to perform any suitable intervention operation, including not exclusively well logging operations.

The invention claimed is:

1. An apparatus for fitting to a wellbore, the apparatus comprising:

a battery-powered downhole tool for deployment within the wellbore, the downhole tool comprising a battery for providing electrical power to one or more components of the downhole tool, and a rope socket connected to the downhole tool, the rope socket for connection to a slickline for use in deploying the downhole tool;

a lubricator for fitting to a wellhead of the wellbore via a valve system providing communication between the lubricator and the wellbore, and for housing the downhole tool when in a stowed position, the lubricator comprising a transmitter for receiving electrical power from a remote power source, and for transferring received electrical power to a receiver; and the downhole tool comprising the receiver for providing electrical power to the battery of the downhole tool, and for receiving electrical power from the transmitter, the rope socket positioned between the transmitter and the receiver when the downhole tool is in the stowed position.

2. The apparatus of claim 1, wherein the transmitter is integral with the lubricator.

3. The apparatus of claim 1, further comprising an alignment guide for aligning the transmitter of the lubricator with the receiver of the downhole tool.

4. The apparatus of claim 3, wherein the alignment guide is configured to align the transmitter with the receiver when the downhole tool is in the stowed position.

5. The apparatus of claim 1, further comprising a controller for controlling at least one of electrical power transfer from the transmitter to the receiver, and deployment of the downhole tool within the wellbore, wherein the controller is configured to control electrical power transfer or deployment of the downhole tool based on a parameter satisfying a threshold, and wherein the parameter comprises a power level of the battery, a temperature of the battery, and a power transfer efficiency between the transmitter and receiver.

6. The apparatus of claim 1, further comprising a sensor for sensing a parameter comprising a power level of the battery, a temperature of the battery, and a power transfer efficiency between the transmitter and receiver.

7. The apparatus of claim 1, wherein the receiver is configured to extract electrical power from the transmitter when the downhole tool is in the stowed position.

8. The apparatus of claim 1, wherein the receiver is configured to extract electrical power from the transmitter via wireless power transfer, and wherein the transmitter is configured to transfer electrical power to the receiver via electric field and/or magnetic field coupling.

9. The apparatus of claim 1, wherein the transmitter comprises an electrical connector, and the receiver comprises a corresponding electrical connector, the electrical connectors configured to establish an electrical connection to transfer electrical power from the transmitter to the receiver.

10. The apparatus of claim 9, wherein the electrical connectors are configured to establish the electrical connection to transfer electrical power from the transmitter to the receiver when the downhole tool is in the stowed position.

11. The apparatus of claim 1, wherein the downhole tool is configured for deployment within the wellbore via the slickline.

12. The apparatus of claim 1, further comprising a remote power source electrically connected to the transmitter.

13. A method of transferring power from a transmitter of a lubricator to a receiver of a downhole tool, the lubricator for fitting to a wellhead of a wellbore via a valve system providing communication between the lubricator and the wellbore, and for housing the downhole tool when in a stowed position, the downhole tool for deployment within the wellbore, wherein a rope socket is connected to the downhole tool and the rope socket is for connecting to a slickline for use in deploying the downhole tool, the method comprising:

stowing the downhole tool in the stowed position, in which the downhole tool is received within the lubricator fitted to the wellhead of the wellbore via the valve system providing communication between the lubricator and the wellbore, the rope socket positioned between the transmitter and the receiver when the downhole tool is in the stowed position; and transferring, from the transmitter, electrical power to the receiver of the downhole tool.

14. The method of claim 13, further comprising receiving electrical power from the transmitter at the receiver for powering a battery of the downhole tool.

15. The method of claim 13, wherein transferring electrical power comprises transferring electrical power via a connector of the transmitter and a corresponding connector of the receiver, the connectors configured to establish an electrical connection when the downhole tool is in the stowed position, and/or wherein transferring electrical power comprises transferring electrical via wireless power transfer.

16. The method of claim 13, further comprising at least one of controlling transferring the electrical power based on a parameter satisfying a threshold; and aligning the receiver with the transmitter.

17. The method of claim 13, further comprising:

deploying the downhole tool within the wellbore; and controlling deployment of the downhole tool based on a parameter satisfying a threshold.

* * * * *